US006387868B1

(12) United States Patent
Uno et al.

(10) Patent No.: US 6,387,868 B1
(45) Date of Patent: May 14, 2002

(54) CLEAR LIQUID DETERGENT CONTAINING ALKYLBENZENESULFONATE ANIONIC SURFACTANT AND LIQUID SODIUM SILICATE AND SURFACTANTS IN WATER

(75) Inventors: Minoru Uno; Tsutomu Uno; Hisashi Uno, all of Ampachi-gun (JP)

(73) Assignee: Uno Shoyu Co., Ltd. (JP)

( * ) Notice: Subject to any disclaimer, the term of this patent is extended or adjusted under 35 U.S.C. 154(b) by 0 days.

(21) Appl. No.: 09/367,737

(22) PCT Filed: Dec. 17, 1998

(86) PCT No.: PCT/JP98/05723

§ 371 Date: Aug. 18, 1999

§ 102(e) Date: Aug. 18, 1999

(87) PCT Pub. No.: WO99/31209

PCT Pub. Date: Jun. 24, 1999

(30) Foreign Application Priority Data

Dec. 18, 1997 (JP) ..... 9-349458

(51) Int. Cl.[7] ..... C11D 17/00

(52) U.S. Cl. ..... 510/426; 510/421; 510/424; 510/428; 510/477; 510/511

(58) Field of Search ..... 510/421, 422, 510/424, 426, 428, 477, 511, 568

(56) References Cited

U.S. PATENT DOCUMENTS 5,759,980 A * 6/1998 Russo et al. ..... 510/241
5,863,878 A * 1/1999 Carr et al. ..... 510/352

FOREIGN PATENT DOCUMENTS

| | | | |
|---|---|---|---|
| JP | 48-89209 | A2 | 11/1973 |
| JP | 52-82908 | A2 | 7/1977 |
| JP | 57-16098 | | 1/1982 |
| JP | 59-182897 | | 10/1984 |
| JP | 7-506608 | T2 | 7/1995 |
| JP | 8-3594 | | 1/1996 |
| JP | 8-218095 | | 8/1996 |
| JP | 8-283972 | A2 | 10/1996 |

OTHER PUBLICATIONS

Korean Office Action dated Oct. 29, 2001, in connection with Korean Patent Application No. 10–1999–7007187.

* cited by examiner

*Primary Examiner*—Necholus Ogden
(74) *Attorney, Agent, or Firm*—Pennie & Edmonds LLP

(57) ABSTRACT

A clear liquid detergent containing, in water, an alkylbenzenesulfonic anion surfactant, liquid sodium silicate, a polyoxyethylene alkyl or aryl ether nonionic surfactant and an alkylethersulfate salt anionic surfactant.

65 Claims, No Drawings

CLEAR LIQUID DETERGENT CONTAINING ALKYLBENZENESULFONATE ANIONIC SURFACTANT AND LIQUID SODIUM SILICATE AND SURFACTANTS IN WATER

TECHNICAL FIELD

The present invention relates to a novel liquid detergent containing an alkylbenzenesulfonate salt anionic surfactant and liquid sodium silicate, and more specifically to a clear liquid detergent containing an alkylbenzenesulfonic anionic surfactant and liquid sodium silicate in water.

BACKGROUND ART

As a technique established to manufacture a liquid detergent which utilizes an alkylbenzenesulfonate salt which is an anionic surfactant, it is known to neutralize a soft or linear alkylbenzenesulfonic acid by adding thereto sodium hydroxide in a certain amount of water, to combine therewith other surfactants, water, a pH adjusting agent, a buffering agent, a thickener, a clouding inhibitor and the like. As the alkylbenzenesulfonic acid, a hard type (a type having an alkyl group consisting of a tetramer of propylene) has been conventional used; however nowadays, a linear type is mainly used. As the other surfactants, polyoxyethylene alkyl ether, which is a nonionic surfactant, is used. Further, as a softener which imparts a softness to an article to be washed, an aliphatic quaternary ammonium salt, which is a cationic surfactant, is used. Furthermore, polyethylene glycol is used for the purposes of preventing the freezing of the liquid detergent, stabilization of the viscosity, and improvement of the compatibility with the other surfactant, and its moistness.

Until now, various studies have been conducted in an attempt to further improve the detergency power of the liquid detergent containing an alkylbenzenesulfonate salt anionic surfactant such as described above; however a satisfactory results have not yet been achieved.

Incidentally, it is known that sodium silicate, which is a liquid silicate salt, potentially has a detergency power higher than that of any other surfactants. Therefore, the detergency power is expected to be further enhanced, if sodium silicate can be blended into the above-described conventional liquid detergent containing alkylbenzenesulfonate salt anionic surfactant.

However, it is recognized by ordinary persons skilled in the art that it is technically difficult to obtain a liquid detergent by mixing the conventional liquid agent having the above-described composition and sodium silicate together. In fact, when they are mixed together, a severe reaction takes place to bring about gelation. Thus, at present, as a detergent containing an alkylbenzenesulfonate salt anionic surfactant and sodium silicate, only the powdery detergent is produced by utilizing the gelation reaction.

In order to produce the powdery detergent, it is necessary to dry the gel and make it into powder, thus increasing the production cost. In addition, in some cases, the powder detergent does not dissolve into cleaning water depending upon the temperatures at use. The undissolved detergent powder may remain to be attached to an article to be washed, such as a cloth. Such remaining detergent may cause a skin affection such as skin allergy to a person who wears the cloth.

It is therefore an object of the present invention to provide a clear liquid detergent which contains is sodium silicate together with alkylbenzenesulfonate salt anionic surfactant, which cannot be achieved by the conventional technique, and which can be diluted and dissolved easily into water and does not generate a precipitate or become cloudy over a long period of time.

DISCLOSURE OF THE INVENTION

The present inventors conducted intensive studies for a long period of time in an attempt to develop a clear or transparent liquid detergent containing an alkylbenzenesulfonate salt anionic surfactant and liquid sodium silicate, and found at last that the alkylbenzenesulfonate salt anionic surfactant and sodium silicate can form, in water, the target clear liquid detergent in the co-presence of polyoxyethylene alkyl or aryl ether nonionic surfactant and alkylethersulfate salt anionic surfactant, which has led to the present invention.

Thus, according to the present invention, there is provided a clear liquid detergent containing an alkylbenzenesulfonate salt anionic surfactant, liquid sodium silicate, a polyoxyethylene alkyl or aryl ether nonionic surfactant, and an alkylethersulfate salt anionic surfactant in water. The clear liquid detergent may also contain a fluorosurfactant.

In the clear liquid detergent of the present invention, it is preferred that the alkylbenzenesulfonate salt be contained in an amount of about 5 to about 15.5% by weight, and the sodium silicate be contained in an amount of about 1 to about 7.5% by weight. In the clear liquid detergent of the present invention, it is preferred that the polyoxyethylene alkyl or aryl ether nonionic surfactant be contained in an amount of about 1 to about 10% by weight, and the alkylethersulfate salt anionic surfactant be contained in an amount of about 1 to about 15% by weight. The fluorosurfactant, if it is added, should be contained in the clear liquid detergent of the present invention preferably in an amount of 0.01 to 0.1% by weight, more preferably in an amount of 0.01 to 0.09% by weight.

The clear liquid detergent of the present invention may further contain a metal-chelating agent, a pH adjusting agent and a freezing/clouding inhibitor. In such a case, it is preferred that the metal-chelating agent be contained in an amount of about 0.5 to about 3% by weight, the pH adjusting agent be contained in an amount of about 0.05 to about 5% by weight, and the freezing/clouding agent be contained in an amount of about 0.1 to about 3% by weight.

Further, according to the present invention, there is provided a clear liquid detergent prepared by blending liquid sodium silicate in an amount of about 1 to about 7.5% by weight, a metal-chelating agent in an amount of about 0.5 to about 3% by weight, a pH adjusting agent in an amount of about 0.05 to about 5% by weight, an alkylbenzenesulfonic acid in an amount of about 5 to about 15% by weight, an alkali metal hydroxide, as a neutralizing agent for the alkylbenzenesulfonic acid, in an amount of about 1 to about 4.5% by weight, a fluorosurfactant in an amount of 0 to about 0.1% by weight, a polyoxyethylene alkyl or aryl ether nonionic surfactant in an amount of about 1 to about 10% by weight, an alkylethersulfate salt anionic surfactant in an amount of about 1 to about 15% by weight, a freezing/clouding inhibitor in an amount of about 0.1 to about 3% by weight, and the balance of water.

Furthermore, according to the present invention, there is provided a clear liquid detergent prepared by blending liquid sodium silicate in an amount of about 1 to about 6% by weight, a metal-chelating agent in an amount of about 0.5 to about 2.5% by weight, a pH adjusting agent in an amount of about 0.05 to about 4% by weight, an alkylbenzenesulfonic acid in an amount of about 5 to about 12.5% by weight, an alkali metal hydroxide, as a neutralizing agent for the alkylbenzenesulfonic acid, in an amount of about 1 to about 4% by weight, a fluorosurfactant in an amount of 0 to about 0.09% by weight, a polyoxyethylene alkyl or aryl ether nonionic surfactant in an amount of 1 to 8.5% by weight, an alkylethersulfate salt anionic surfactant in an amount of about 1 to about 14% by weight, a freezing/clouding inhibitor in an amount of about 0.1 to about 2.5% by weight, and the balance of water.

Furthermore, according to the present invention, there is provided a clear liquid detergent prepared by adding, to (1) a mixed surfactant aqueous solution containing a polyoxyethylene alkyl or aryl ether nonionic surfactant, a freezing/clouding inhibitor, an alkylethersulfate salt anionic surfactant and water, (2) a sodium silicate aqueous solution containing liquid sodium silicate, a metal-chelating agent, a pH adjusting agent and water; and adding, to the resultant mixture, (3) an alkylbenzenesulfonate salt anionic surfactant aqueous solution prepared by adding water and an alkali metal hydroxide as a neutralizing agent to an alkylbenzenesulfonic acid.

The clear liquid detergent of the present invention preferably contains the alkylbenzenesulfonate salt anionic surfactant in an amount of about 5 to about 15.5% by weight, and the liquid sodium silicate in an amount of about 1 to about 7.5% by weight.

The liquid detergent of the present invention, when diluted 1000-fold, exhibits a weak alkalinity (a pH value of higher than 7 but lower than 8).

BEST MODE OF CARRYING OUT THE INVENTION

The present invention will now be described in more detail.

It is preferable that the alkylbenzenesulfonate salt anionic surfactant used characteristically in the clear liquid detergent of the present invention be made of a linear alkylbenzenesulfonate salt such as linear dodecylbenzenesulfonate salt, in particular. The linear alkylbenzenesulfonate can be represented by general formula $RC_6H_4SO_3M$, where R represents preferably a linear $C_{11}$ to $C_{14}$ alkyl group, particularly, a linear dodecyl group, and M represents an alkali metal, particularly, sodium. Although such a linear alkylbenzenesulfonate salt anionic surfactant may be commercially available, it is preferable that the surfactant be prepared by neutralizing a linear alkylbenzenesulfonic acid with an alkali metal hydroxide, such as sodium hydroxide or potassium hydroxide, in water.

Liquid sodium silicate contained characteristically, together with the alkylbenzenesulfonate salt anionic surfactant, in the clear liquid detergent of the present invention, imparts an excellent detergency power to the detergent, together with predetermined surfactants, which will be explained later, and is an essential component for the detergent to function as such a detergent. The clear liquid detergent of the present invention exhibits such an excellent and high detergency power that cannot be achieved by a conventional detergent, by containing liquid sodium silicate.

As such liquid sodium silicate, use may be made of sodium silicate No. 1 as specified by JIS (specific gravity: 59.2 Be (Baume degree) or higher (15° C.); silicon dioxide ($SiO_2$): 35 to 38% by weight; sodium oxide ($Na_2O$): 17 to 19% by weight, iron (Fe): 0.03% by weight or less, and water-insoluble component: 0.2% by weight or less), sodium silicate No. 2 as specified by JIS (specific gravity: 54 Be or higher (15° C.); silicon dioxide ($SiO_2$): 34 to 36% by weight; sodium oxide ($Na_2O$): 14 to 15% by weight, iron (Fe): 0.03% by weight or less, and water-insoluble component: 0.2% or less by weight), and sodium silicate No. 3 as specified by JIS (specific gravity: 40 Be or higher (15° C.); silicon dioxide (SiO2): 28 to 30% by weight; sodium oxide ($Na_2O$): 9 to 10% by weight, iron (Fe): 0.02% by weight, and water-insoluble component: 0.2% by weight or less). In general, sodium silicate used in the present invention can be represented also by formula: $Na_2O.nSiO_2$, and in the case where n=about 2 to 4, it is liquid. Apart from the JIS products or commercially available products, a prepared product obtained by mixing sodium oxide and silicon dioxide at a ratio of 1 mole of the former to 2 to 4 moles of the latter, can be used. As liquid sodium silicate, JIS sodium silicate No. 2 and sodium silicate No. 3 are preferable, and in particular the silicate No. 2 is more preferable.

Additional surfactants which are used in the clear liquid detergent of the invention together with the alkylbenzenesulfonate salt anionic surfactant and the liquid sodium silicate are a polyoxyethylene alkyl or aryl ether nonionic surfactant and an alkylethersulfate salt anionic surfactant. Further, a fluorosurfactant can also be used. As these surfactants, commercially available products can be used.

Preferable examples of the polyethylene alkyl or aryl ether nonionic surfactant are polyoxyethylene primary or secondary alkyl ethers, and polyethylene alkylphenyl ethers. A mixture of these can be used.

Polyoxyethylene alkyl ether can be represented by general formula:

$$RO(CH_2CH_2O)_nH$$

where R represents a primary or secondary alkyl group, preferably a $C_8$ to $C_{18}$ alkyl group, particularly, a $C_{12}$ alkyl group, and n represents 7 to 10. Polyoxyethylene alkylphenyl ether can be represented by general formula:

$$R—C_6H_4—O(CH_2CH_2O)_nH$$

where R represents an alkyl group, preferably a $C_8$ to $C_9$ alkyl group, and n represents 9 to 12.

Preferable examples of the alkylethersulfate salt anionic surfactant are primary or secondary higher alcoholethoxysulfates, alkylphenolsulfates, and a mixture of these of these, primary and secondary alcoholethoxysulfates are particularly preferable, each of which has an excellent detergency and an excellent foaming property, and is less irritative to skin.

Primary alcoholethoxysulfate can be represented by general formula:

$$R—(OCH_2CH_2)_nOSO_3M$$

where R represents a primary alkyl group, particularly, a $C_{12}$ alkyl group, M represents a cation, particularly an alkali metal such as sodium, and n represents 1 to 10. Secondary alcoholethoxysulfate can be represented by general formula:

$$R(R\acute{i})\text{-}CH—(OCH_2CH_2)_nOSO_3M$$

where R represents an alkyl group, particularly, a $C_6$–$C_{10}$ alkyl group, $R\acute{i}$ represents an alkyl group, particularly, a $C_2$–$C_4$ alkyl group, M represents a cation, particularly an alkali metal such as sodium, and n represents 1 to 10.

The fluorosurfactant, which may be optionally blended in the detergent of the present invention, is preferably a surfactant having a perfluorocarbon chain, and exhibits a very excellent surface activity at low concentrations. As the fluorosurfactant, an anionic type, nonionic type or ampholytic type can be used. Preferable examples of the fluorosurfactant are perfluoroalkylcarboxylic acid ($C_7$–$C_{13}$), perfluorooctanesulfonic acid diethanolamide, perfluoroalkyl ($C_4$–$C_{12}$) sulfonate salt (Li salt, K salt, Na salt or the like), N-propyl-N-(2-hydroxyethyl)perfluorooctanesulfonamide, perfluoroalkyl ($C_6$–$C_{10}$)-sulfonamidopropyltrimethylammonium salt, perfluoroalkyl ($C_6$–$C_{10}$)-N-ethylsulfonylglycine salt (K salt or the like), monoperfluoroalkyl ($C_6$–$C_{10}$) ethylphosphoric acid ester, and a mixture of these. Of these, perfluoroalkylcarboxylic acid ($C_7$ to $C_{13}$) is particularly preferable.

The clear liquid detergent of the present invention contains the alkylbenzenesulfonate salt anionic surfactant in an amount of preferably about 5–about 15.5% by weight, more preferably about 5.125–about 15.375% by weight, particularly preferably about 5–about 8.5% by weight, and the sodium silicate in an amount of preferably about 1–about 7% by weight, particularly preferably about 4–about 5.5% by weight. Further, the clear liquid detergent of the present invention contains the polyoxyethylene alkyl or aryl ether nonionic surfactant in an amount of preferably about 1–about 10% by weight, more preferably about 1–about 8.5% by weight, and the alkylethersulfate salt anionic surfactant in an amount of preferably about 1–about 15% by weight, more preferably about 1–about 14% by weight. The clear liquid detergent may contain the fluorosurfactant in an amount of 0–about 0.1% by weight, preferably about 0.01–about 0.1% by weight, more preferably about 0.01–about 0.09% by weight.

Further, it is preferable that the clear liquid detergent of the present invention contain a metal-chelating agent, a pH adjusting agent and a freezing/clouding inhibitor.

The metal-chelating agent chelates sodium silicate so as to capture it, thus stabilizing it. Preferable examples of the metal-chelating agent are ethylenediaminetetraacetic acid-based metal-chelating agents such as ethylenediaminetetraacetic acid (EDTA), tetrasodium ethylenediaminetetraacetate salt, disodium ethylenediaminetetraacetate salt and a mixture of these, and tetrasodium ethylenediaminetetraacetate salt is particularly preferable.

As the pH adjusting agent, a malic acid (particularly DL-malic acid), citric acid and/or sodium citrate can be preferably used. Citric acid and/or DL-malic acid are particularly preferable.

The freezing/clouding inhibitor inhibits the freezing and suppress the clouding of the clear liquid detergent of the present invention, and fatty acid alkanolamide, which is a nitrogen-containing nonionic surfactant, is preferably used. Fatty acid alkanolamide can function also as an agent for inhibiting reattachment of dirt. The fatty acid alkanolamide is a condensation product of a fatty acid (preferably $C_8$ to $C_{18}$ fatty acid), such as capric acid, lauric acid, coconut oil fatty acid, myristic acid, stearic acid or oleic acid, with an alkanolamine (preferably $C_8$ to $C_{18}$ alkanolamine), such as diethanolamine, monoethanolamine or isopropanolamine. Such fatty acid alkanolamides are commercially available. The fatty acid alkanolamide can be used in the form of mixture.

In the clear liquid detergent of the present invention, the metal-chelating agent is contained preferably in an amount of about 6% by weight or less, more preferably in an amount of about 0.5%–about 3% by weight, most preferably in an amount of about 0.5%–about 2.5% by weight.

In the clear liquid detergent of the present invention, the pH adjusting agent is contained preferably in an amount of about 5.5% by weight or less, more preferably in an amount of about 0.05%–about 5% by weight, most preferably in an amount of about 0.05%–about 4% by weight.

In the clear liquid detergent of the present invention, the freezing/clouding inhibitor is contained preferably in an amount of about 0.1%–about 3% by weight, more preferably in an amount of about 0.1%–about 2.5% by weight.

Thus, in a particularly preferable embodiment, the clear liquid detergent of the present invention contains the alkylbenzenesulfonate salt anionic surfactant in an amount of about 5–about 15.5% by weight, more preferably about 5.125–about 15.375% by weight, particularly preferably about 5–about 8.5% by weight, the sodium silicate in an amount of about 1–about 7% by weight, particularly preferably about 4–about 5.5% by weight, the polyoxyethylene alkyl or aryl ether nonionic surfactant in an amount of about 1–about 10% by weight, more preferably about 1–about 8.5% by weight, the alkylethersulfate salt anionic surfactant in an amount of about 1–about 15% by weight, more preferably about 1–about 14% by weight, the metal-chelating agent in an amount of about 0.5%–about 3% by weight, more preferably in an amount of about 0.5%–about 2.5% by weight, the pH adjusting agent in an amount of about 0.05%–about 5% by weight, more preferably in an amount of about 0.05%–about 4% by weight, the freezing/clouding inhibitor in an amount of about 0.1%–about 3% by weight, more preferably in an amount of about 0.1%–about 2.5% by weight, and the balance of water. The detergent can contain the fluorosurfactant in an amount of 0–about 0.1% by weight, preferably about 0.01–about 0.1% by weight, more preferably about 0.01–about 0.09% by weight.

In another preferable aspect, the clear liquid detergent of the present invention can be prepared by blending liquid sodium silicate in an amount of about 1–about 7.5% by weight, especially in an amount of about 1–about 6% by weight, the metal-chelating agent in an amount of about 0.5–about 3% by weight, especially in an amount of about 0.5–about 2.5% by weight, the alkylbenzenesulfonic acid in an amount of about 5–about 15% by weight, especially in an amount of about 5–about 12.5% by weight, the alkali metal hydroxide in an amount of about 1–about 4.5% by weight, especially in an amount of about 1–about 4% by weight, the fluorosurfactant in an amount of 0–about 0.1% by weight, especially in an amount of 0–about 0.09% by weight, the polyoxyethylene alkyl or aryl ether nonionic surfactant in an amount of about 1–about 10% by weight, especially in an amount of about 1–about 8.5% by weight, the alkylethersulfate salt anionic surfactant in an amount of about 1–about 15% by weight, especially in an amount of about 1–about 14% by weight, the freezing/clouding inhibitor in an amount of about 0.1–about 3% by weight, especially in an amount of about 0.1–about 2.5% by weight, and the balance of water. In this case, needless to say, the alkylbenzenesulfonic acid and the alkali metal hydroxide are present in the final clear liquid detergent not as they are in original states, but the alkylbenzenesulfonic acid are present in the final clear liquid detergent in the form of alkali metal salts after reacted with the alkali metal. The amount of the alkylbenzenesulfonate, corresponding to the amount of alkylbenzenesulfonic acid used, can be calculated stoichiometrically.

A particularly preferable method for preparing the clear liquid detergent of the present invention is to prepare in advance (a) an aqueous solution of an alkylbenzenesulfonate salt anionic surfactant by adding, to an alkylbenzenesulfonic acid, water and an alkali metal hydroxide (such as sodium hydroxide or potassium hydroxide, preferably sodium hydroxide) as a neutralizing agent for the alkylbenzenesulfonic acid in order to neutralize the alkylbenzenesulfonic acid; (b) an aqueous solution of sodium silicate, which contains liquid sodium silicate, a metal-chelating agent, a pH adjusting agent and water; and (c) an aqueous solution of a mixed surfactant by blending a polyoxyethylene alkyl or aryl ether nonionic surfactant, a freezing/clouding inhibitor, an alkylethersulfate salt anionic surfactant, water and, optionally, a fluorosurfactant.

Then, particularly preferably, the aqueous solution of sodium silicate (b) is gradually added to and mixed with the aqueous solution of the mixed surfactant (c), and the aqueous solution of the alkylbenzenesulfonate salt anionic surfactant (a) is gradually added to and mixed with the resultant mixture, thus preparing the clear liquid detergent of the present invention.

The composition of each of the solution (a), solution (b) and solution (c) will now be described. In the following, the solution (a), solution (b) and solution (c) are mixed so that the total is 100 parts by weight.

When preparing the aqueous solution (a) of alkylbenzenesulfonate salt anionic surfactant, the alkylbenzenesulfonic acid should be blended preferably in an amount of about 5–about 15 parts by weight. If the amount of the alkylbenzenesulfonic acid blended is less than 5 parts by weight, a sufficient detergency power may not be obtained. On the other hand, if the blended amount exceeds 15 parts by weight, a deposit may be created in the final detergent composition due to the interaction with sodium silicate. It is particularly preferable that the alkylbenzenesulfonic acid be blended in an amount of about 5–about 12.5 parts by weight.

The alkali metal hydroxide, particularly sodium hydroxide, which is used as a neutralizing agent for the alkylbenzenesulfonic acid in order to prepare the aqueous solution (a) of the alkylbenzenesulfonate salt anionic surfactant, is blended preferably in an amount of about 1–about 4.5 parts by weight. If the amount of the alkali metal hydroxide is less than 1 part by weight, a sufficient neutralization of the alkylbenzenesulfonic acid may not be achieved. On the other hand, the blended amount exceeding 4.5 parts by weight exceeds the necessary amount for the neutralization of the alkylbenzenesulfonic acid, and is not economical, and may lead to too much alkali. It is particularly preferable that the alkali metal hydroxide be blended in an amount of about 1–about 4 parts by weight.

In the aqueous solution (a) of the alkylbenzenesulfonate salt anionic surfactant, water is blended preferably in an amount of about 20–about 48.5 parts by weight. If the amount of water blended is less than 20 parts by weight, the viscosity of alkylbenzenesulfonate salt excessively increases due to the neutralization, and therefore it may become difficult to handle the solution (a). In the solution (a), it is particularly preferable that water be blended in an amount of 20 to 44.95 parts by weight.

It should be noted that when preparing the aqueous solution (a) of the alkylbenzenesulfonate salt surfactant, the metal-chelating agent can be blended in an amount of about 3 parts by weight or less, preferably in an amount of 0.5–about 3 parts by weight, more preferably in an amount of about 0.5–about 2.5 parts by weight, and the pH adjusting agent can be blended in an amount of about 0.5 parts by weight or less, preferably in an amount of about 0.05–about 0.5 parts by weight, more preferably in an amount of 0.05 to about 0.45 parts by weight. In the case where the metal-chelating agent and the pH adjusting agent are added, the amount of water blended in the solution (a) should preferably be 20 to 45 parts by weight, particularly, 20 to 45 parts by weight. However, the addition of the metal-chelating agent and the pH adjusting agent tends to cause a layer separation in the solution (a) of the alkylbenzenesulfonate salt anionic surfactant, thus necessitating continuous stirring of the solution (a) of the alkylbenzenesulfonate salt surfactant in continuously producing the clear liquid detergent of the invention.

In the sodium silicate aqueous solution (b), the liquid sodium silicate is blended preferably in an amount of about 1–about 7.5 parts by weight. If the blended amount of liquid sodium silicate is less than 1 part by weight, a sufficient detergency effect may not be obtained, whereas if the blended amount exceeds 7.5 parts by weight, a silica deposit may be created. It is preferable that the liquid sodium silicate be blended in an amount of about 1 to about 6 parts by weight.

In the sodium silicate aqueous solution (b), the metal-chelating agent is blended preferably in an amount of about 0.5–about 3 parts by weight. If the blended amount of the metal-chelating agent is less than 0.5 parts by weight, a sufficient chelating effect for the sodium silicate may not be obtained. If the blended amount exceeds 3 parts by weight, the chelating effect is not particularly improved. It is particularly preferable that the metal-chelating agent be blended in an amount of about 0.5 to about 2.5 parts by weight.

In the sodium silicate aqueous solution (b), the pH adjusting agent is blended preferably in an amount of about 0.05–about 5 parts by weight. If the blended amount of the pH adjusting agent is less than 0.05 parts by weight, it may not contribute to the adjustment of pH (lowering of pH). If the blended amount exceeds 5 parts by weight, pH may be excessively lowered. It is particularly preferable that the Ph adjusting agent be blended in an amount of about 0.05–about 4 parts by weight.

In the sodium silicate aqueous solution (b), water is blended preferably in an amount of about 1–about 20 parts by weight. If the amount is less than 1 part by weight, organic acids such as the pH adjusting agent may not sufficiently dissolve. In the solution (b), it is particularly preferable that water be blended in an amount of about 1 to about 18 parts by weight.

Next, in the aqueous solution (c) of the mixed surfactant, the polyoxyethylene alkyl or aryl ether nonionic surfactant is blended preferably in an amount of about 1–about 10 parts by weight. If the amount of the nonionic surfactant blended is less than 1 part by weight, a sufficient detergency effect may not be obtained on the other hand, if the blended amount exceeds 10 parts by weight, the viscosity may excessively increase or foaming may occur, causing a difficulty in handling the obtained solution (c). It is particularly preferable that the nonionic surfactant be blended in an amount of about 1–about 8.5 parts by weight.

In the aqueous solution (c) of the mixed surfactant, the alkylethersulfate salt anionic surfactant be blended preferably in an amount of about 1–about 15 parts by weight. If the amount of the anionic surfactant blended is less than 1 part by weight, a sufficient detergency effect may not be obtained. On the other hand, if the blended amount exceeds 15 parts by weight, the viscosity may excessively increase or foaming may be generated, causing a difficulty in handling the obtained solution (c). It is particularly preferable that the anionic surfactant should be in an amount of about 1–about 14 parts by weight.

In the aqueous solution (c) of the mixed surfactant, the freezing/clouding inhibitor is blended preferably in an amount of about 0.1–about 3 parts by weight. If the amount of the freezing/clouding inhibitor blended is less than 0.1 part by weight, a sufficient freezing/clouding inhibiting effect may not be obtained. On the other hand, if the blended amount thereof exceeds 3 parts by weight, the detergency effect may become an equilibrium state or foaming may be generated causing a difficulty in handling the obtained solution (c). It is particularly preferable that the freezing/clouding inhibitor be blended in an amount of abut 0.1–about 2.5 parts by weight.

In the aqueous solution (c) of the mixed surfactant, water is blended preferably in an amount of about 10 to about 30.1 parts by weight. If the amount of water blended is less than 10 part by weight, the viscosity of the solution (c) may become excessively high, causing a difficulty in handling the obtained solution. It is particularly preferable that water be blended in an amount of about 10–about 28.09 parts by weight.

In the aqueous solution (c) of the mixed surfactant, the fluorosurfactant, if contained, is blended preferably in an amount of about 0.1 part by weight or less, more preferably about 0.01–0.1 part by weight. If the amount of the fluorosurfactant is less than 0.01 part by weight, a sufficient detergency power to be obtained from the surfactant may not be exhibited sufficiently. On the other hand, if the blended amount thereof exceeds 0.1 part by weight, the detergency effect may not be further improved. It is particularly preferable that the fluorosurfactant be blended in an amount of 0.01–about 0.09 parts by weight. In the case where the fluorosurfactant is added, the amount of water blended into the aqueous solution (c) of the mixed surfactant is preferably about 10 to about 30 parts by weight, particularly preferably about 10 to about 28 parts by weight.

The water used in the present invention may be any water including distilled water, purified pure water, ion exchanged soft water, regular tap water, and ground water. However, it is preferable that water from which iron component has been removed be used.

Further, the clear liquid detergent of the present invention can contain a viscosity adjusting agent such as carboxymethylcellulose for the purpose of adjusting the viscosity.

In the case where alkylbenzenesulfonate salt anionic surfactant itself is used as the starting material, the alkali metal hydroxide as a neutralizing agent is not necessary. In such a case, it is possible to prepare an aqueous solution, corresponding to the aqueous solution (a) of the alkylbenzenesulfonate salt anionic surfactant, by using about 5–about 15.5 parts by weight of alkylbenzenesulfonate (preferably about 5.125 parts by weight–about 15.375 parts by weight), 0–about 3 parts by weight of the metal-chelating agent, 0–about 0.5 parts by weight of the pH adjusting agent, and about 21.55–30 parts by weight of water (preferably about 21.55–about 29.5 parts by weight). Then, the clear liquid detergent of the present invention can be prepared by using this together with the aqueous solution (c) of the mixed surfactant and the aqueous solution (b) of sodium silicate and blending them similarly.

The clear liquid detergent of the present invention maintains the transparency of a so-called crystal-clear type, which does not generate a deposit or precipitate (precipitate such as silica precipitated from sodium silicate, or sodium sulfate made by the reaction between the surfactant and alkali) without creating cloud even the temperature varies, and the detergent is readily dissolved in water. Further, the detergent of the present invention is far superior to the conventional detergent in terms of detergency power. The clear liquid detergent composition of the present invention exhibits an excellent detergency power in cleaning of clothes, and cleaning of a washing niche, toilet, bathroom including a bath tub. Further, when diluted with water, the detergent exhibits an excellent power in cleaning dishes. When diluted with water 1000-fold, the clear liquid detergent of the present invention exhibits a weak alkalinity (a pH value of higher than 7, but less than 8). Further, since the amount of the nonionic surfactant used is extremely limited, the detergent is environmentally friendly. For example, in the case where the clear liquid detergent of the present invention is used for washing clothes, it is preferable that the clear liquid detergent of the present invention be dissolved at ratio of 0.8 to 1.0 g per 1 L (liter) of water.

EXAMPLE 1

<Preparation of the Aqueous Solution (a) of the Alkylbenzenesulfonate Salt Surfactant>

To 6.25 parts by weight of commercially available linear dodecylbenzenesulfonic acid (LIPON LH-500 of Lion Fat & Oil Co., Ltd.), 22.25 parts by weight of water was added, and further 0.625 parts by weight of tetrasodium ethylenediaminetetraacetate salt and 0.0625 parts by weight of citric acid (crystal) were mixed thereto to be dissolved. To the mixture, an aqueous solution obtained by dissolving 1.71875 parts by weight of sodium hydroxide (anhydride) into 19.09375 parts by weight of water, was mixed and stirred so as to neutralize the dodecylbenzenesulfonic acid to prepare a desired aqueous solution (a-1) of alkylbenzenesulfonate salt anionic surfactant.

<Preparation of the Aqueous Solution (b) of Sodium Silicate>

To 4.29 parts by weight of sodium silicate No. 2 as specified by JIS, 0.871 parts by weight of tetrasodium ethylenediaminetetraacetate salt, then 0.0871 parts by weight of malic acid, and 7.7519 parts by weight of water were added and mixed to prepare an aqueous solution (b-1) of sodium silicate was obtained.

<Preparation of the Aqueous Solution (c) of the Mixed Surfactant>

5.92 parts by weight of a polyoxyethylene alkyl ether nonionic surfactant (PERESOFT 209 of Miyoshi Oil & Fat Co., Ltd.: primary higher alcoholethoxylate), 10.36 parts by weight of an alkylethersulfate salt anionic surfactant (SPANINE C25 of Miyoshi Oil & Fat Co., Ltd.: primary higher alcohol ethoxysulfate), 0.0435 parts by weight of a fluorosurfactant (SURFLON S-111 (water-soluble) of Asahi Glass Co., Ltd.: perfluoro-$C_8$-alkylcarboxylic acid), 0.87 parts by weight of fatty acid alkanolamide (STARRHOME-F of Lion Oil & Fat Co., Ltd.: condensation product of coconut fatty acid and diethanolamine), and 19.8065 parts by weight of water were mixed together and stirred to prepare an aqueous solution (c-1) of the mixed surfactant.

<Preparation of the Clear Liquid Detergent>

To the aqueous solution (c-1) of the mixed surfactant, the aqueous solution (b-1) of sodium silicate was added gradually, and mixed together until homogeneity. To thus obtained homogeneous mixture, the aqueous solution (a-1) of the alkylbenzenesulfonate salt anionic surfactant was added gradually, and stirred to prepare a desired clear liquid detergent of the present invention (detergent A).

EXAMPLE 2

<Preparation of the Aqueous Solution (a) of the Alkylbenzenesulfonate Salt Surfactant>

To 6.25 parts by weight of commercially available linear dodecylbenzenesulfonic acid (LIPON LH-500 of Lion Fat & Oil Co., Ltd.), 22.25 parts by weight of water, 0.625 parts by weight of tetrasodium ethylenediaminetetraacetate salt and 0.0625 parts by weight of citric acid (crystal) were added and mixed together. To thus obtained aqueous solution, an aqueous solution obtained by dissolving 1.71875 parts by weight of sodium hydroxide (anhydride) into 19.09375 parts by weight of water, was mixed and stirred so as to achieve the neutralization to prepare a desired aqueous solution (a-2) of alkylbenzenesulfonate salt anionic surfactant.

<Preparation of the Aqueous Solution (b) of Sodium Silicate>

To 4.29 parts by weight of sodium silicate No. 2 specified by JIS, 0.871 parts by weight of tetrasodium ethylenediaminetetraacetate salt, 0.0871 parts by weight of citric acid (crystal), and 7.7519 parts by weight of water were added one after another and mixed to prepare a desired aqueous solution (b-2) of sodium silicate.

<Preparation of the Aqueous Solution (c) of the Mixed Surfactant>

2.96 parts by weight of a polyoxyethylene alkyl ether nonionic surfactant (PERESOFT 209 of Miyoshi Oil & Fat Co., Ltd.), 5.18 parts by weight of an alkylethersulfate salt anionic surfactant (SAMINE C25 of Miyoshi Oil & Fat Co., Ltd.), 0.0435 parts by weight of a fluorosurfactant (SURFLON S-111 (water-soluble) of Asahi Glass Co., Ltd.), 0.74 parts by weight of fatty acid alkanolamide (STARHOME-F of Lion Oil & Fat Co., Ltd.), and 28.0765 parts by weight of water were mixed together and stirred to prepare a desired aqueous solution (c-2) of the mixed surfactant.

<Preparation of the Clear Liquid Detergent>

To the aqueous solution (c-2) of the mixed surfactant, the aqueous solution (b-2) of sodium silicate was added gradually, and mixed together until homogeneity. To thus obtained homogeneous mixture, the aqueous solution (a-2) of the alkylbenzenesulfonate salt anionic surfactant was added gradually, and stirred to prepare a desired clear liquid detergent of the present invention (detergent B).

EXAMPLE 3

<Preparation of the Aqueous Solution (a) of the Alkylbenzenesulfonate Salt Surfactant>

To 6.25 parts by weight of commercially available linear dodecylbenzenesulfonic acid (LIPON LH-500 of Lion Fat & Oil Co., Ltd.), 22.25 parts by weight of water, 0.625 parts by weight of tetrasodium ethylenediaminetetraacetate salt and 0.0625 parts by weight of DL-malic acid were added and mixed together. To thus obtained aqueous solution, an aqueous solution obtained by dissolving 1.71875 parts by weight of sodium hydroxide (anhydride) into 11.59375 parts by weight of water, was mixed and stirred for neutralization to prepare a desired aqueous solution (a-3) of alkylbenzenesulfonate salt anionic surfactant was obtained.

<Preparation of the Aqueous Solution (b) of Sodium Silicate>

To 5 parts by weight of sodium silicate No. 2 as specified by JIS, 0.871 parts by weight of tetrasodium ethylenediaminetetraacetate salt, then 0.0871 parts by weight of DL-malic acid, and 9.0419 parts by weight of water were added and mixed to prepare a desired aqueous solution (b-3) of sodium silicate was obtained.

<Preparation of the Aqueous Solution (c) of the Mixed Surfactant>

6.8 parts by weight of a polyoxyethylene alkyl ether nonionic surfactant (PERESOFT EFT of Nippon Oils & Fats Co., Ltd.: secondary higher alcohol ethoxylate), 11.9 parts by weight of an alkylethersulfate salt anionic surfactant (SPAMINE C25 of Miyoshi Oil & Fat Co., Ltd.), 0.0435 parts by weight of a fluorosurfactant (SURFLON S-111 (water-soluble) of Asahi Glass Co., Ltd.), 0.74 parts by weight of fatty acid alkanolamide (STARHOME-F of Lion Oil & Fat Co., Ltd.), and 23.0165 parts by weight of water were mixed together and stirred to prepare a desired aqueous solution (c-3) of the mixed surfactant.

<Preparation of the Clear Liquid Detergent>

To the aqueous solution (c-3) of the mixed surfactant, the aqueous solution (b-3) of sodium silicate was added gradually, and mixed together until homogeneity. To thus obtained homogeneous mixture, the aqueous solution (a-3) of the alkylbenzenesulfonate salt anionic surfactant was added gradually, and stirred to prepare a desired clear liquid detergent of the present invention (detergent C).

EXAMPLE 4

<Preparation of the Aqueous Solution (a) of the Alkylbenzenesulfonate Salt Surfactant>

To 7.53 parts by weight of commercially available linear dodecylbenzenesulfonic acid (LIPON LH-500 of Lion Fat & Oil Co., Ltd.), 20.5 parts by weight of water, 0.625 parts by weight of tetrasodium ethylenediaminetetraacetate salt and 0.0625 parts by weight of DL-malic acid were added and mixed together. To thus obtained aqueous solution, an aqueous solution obtained by dissolving 2.07 parts by weight of sodium hydroxide (anhydride) into 9.2125 parts by weight of water, was mixed and stirred for neutralization to prepare a desired aqueous solution (a-4) of alkylbenzenesulfonate salt anionic surfactant.

<Preparation of the Aqueous Solution (b) of Sodium Silicate>

To 5 parts by weight of sodium silicate No. 3 as specified by JIS, 1.05 parts by weight of tetrasodium ethylenediaminetetraacetate salt, 0.1049 parts by weight of DL-malic acid, and 7.9541 parts by weight of water were added and mixed to prepare a desired aqueous solution (b-4) of sodium silicate.

<Preparation of the Aqueous Solution (c) of the Mixed Surfactant>

7.2 parts by weight of a polyoxyethylene alkyl ether nonionic surfactant (PERESOFT 209 of Miyoshi Oil & Fat Co., Ltd.), 12.4 parts by weight of an alkylethersulfate salt anionic surfactant (SPAMINE C25 of Miyoshi Oil & Fat Co., Ltd.), 0.0435 parts by weight of a fluorosurfactant (SURFLON S-111 (water-soluble) of Asahi Glass Co., Ltd.), 0.74 parts by weight of fatty acid alkanolamide (STARHOME-F of Lion Oil & Fat Co., Ltd.), and 25.5165 parts by weight of water were mixed together and stirred to prepare a desired aqueous solution (c-4) of the mixed surfactant was obtained.

<Preparation of the Clear Liquid Detergent>

To the aqueous solution (c-4) of the mixed surfactant, the aqueous solution (b-4) of sodium silicate was added gradually, and mixed together until homogeneity. To thus obtained homogeneous mixture, the aqueous solution (a-4) of the alkylbenzenesulfonate salt anionic surfactant was added gradually, and stirred to prepare a desired clear liquid detergent of the present invention (detergent D) was obtained.

As to the clear liquid detergents A to D obtained as above, the amounts of the components in % by weight are shown in TABLE 1 below. Further, for each of the clear liquid detergents A to D, a pH value and a pH value measured in accordance with JIS K3362-1990 (that is, pH value obtained when diluted with water by 1000-fold: in TABLE 1, it is indicated as a 1000-fold diluted pH value) are indicated in TABLE 1, as well. It should be noted that the pH measurement was carried out by using HM-202, a glass electrode pH meter of TOA DENPA INDUSTRIES Ltd., at a temperature of 15° C.

TABLE 1

(Compositions of Detergents A to D)

| Component | | Amount blended (% by weight) | | | |
|---|---|---|---|---|---|
| | | Example 1 (Detergent A) | Example 2 (Detergent B) | Example 3 (Detergent C) | Example 4 (Detergent D) |
| Alkylbenzenesulfonate aqueous solution | Dodecylbenzene sulfonic acid | 6.25 | 6.25 | 6.25 | 7.53 |
| | Tetrasodium ethlenediamine tetraacetate salt | 0.625 | 0.625 | 0.625 | 0.625 |
| | Citric acid | 0.0625 | 0.0625 | | |
| | Malic acid | | | 0.0625 | 0.0625 |
| | Sodium hydroxide | 1.71875 | 1.71875 | 1.71875 | 2.07 |
| | Water | 41.34375 | 41.34375 | 33.84375 | 29.7125 |
| | Sub-total | 50.0 | 50.0 | 42.5 | 40.0 |
| Sodium silicate aqueous solution | Sodium silicate | 4.29 | 4.29 | 5.0 | 5.0 |
| | Citric acid | | 0.0871 | | |
| | Malic acid | 0.0871 | | 0.0871 | 0.1049 |
| | Tetrasodium ethylenediamine tetraaccetate salt | 0.871 | 0.871 | 0.871 | 1.05 |
| | Water | 7.7519 | 7.7519 | 9.0419 | 7.9451 |
| | Sub-total | 13.0 | 13.0 | 15.0 | 14.1 |
| Mixed surfactant aqueous solution | Polyoxyethylene alkylether | 5.92 | 2.96 | 6.8 | 7.2 |
| | Alkylether sulfate | 10.36 | 5.18 | 11.9 | 12.4 |
| | Perfluoroalkyl-carboxylate | 0.0435 | 0.0435 | 0.0435 | 0.0435 |
| | Fatty acid alkanol-amide | 0.87 | 0.74 | 0.74 | 0.74 |
| | Water | 19.8065 | 28.0765 | 23.0165 | 25.5165 |
| | Sub-total | 37.0 | 37.0 | 42.5 | 45.9 |
| Total | | 100 | 100 | 100 | 100 |
| pH value | | 13.46 | 13.26 | 13.41 | 13.52 |
| 1000-fold diluted pH value | | 7.44 | 7.63 | 7.68 | 7.63 |

The clear liquid detergents A to D obtained in the above EXAMPLES 1 to 4 were measured in terms of transparency, detergency power, stability, cloudiness and viscosity as described below.

<Transparency>

200 mL (mililiter) of each of the detergents is placed in a respective clear glass container having a diameter of 60 mm, and it is evaluated as to whether or not letters in a normal-size Japanese to English dictionary can be identified through the liquid detergent, on the basis of the following standards:

○: letters can be clearly read

Δ: they can be read, but with some difficulty

×: they cannot at all be read

<Evaluation of Detergency Power>

The evaluation of the detergency power was made by the method of evaluating a synthetic detergent for clothes defined in JIS K3362-1990, 7.1, as follows.

a) Preparation of Dirty Collar Cloth

An Indian cotton white cloth was cut into a size of 11×13 cm, and two cut cloth pieces were sewed together to match the short and long sides in the same texture pattern direction with a seam allowance of 1 cm. Thus, a collar cloth (11×24 cm) was made. A many number of such cloth pieces were prepared.

The collar cloth pieces were stitched onto the collars of work clothes, and the work clothes were worn by workers, who work under ordinary working conditions for 2 to 7 days, thus preparing dirty collar clothes.

Of the dirty collar clothes, those which became dirty uniformly to the left and right of the seam line were selected, and they were divided into three levels, that is, very dirty, fairly dirty and little dirty, in accordance with the degree of the dirtiness. 5 of dirty collar clothes were prepared for each level, and therefore a total of 15 clothes were prepared. Then, the thread sewing the seaming allowance portion of each dirty collar cloth was removed, to separate it into two, which were to be used for test. Before the thread on the sewing allowance portion is removed from each dirty collar cloth, symbols which indicate that dirty collar closes are of a symmetrical pair (for example, No. 1 and No. 1ĺ) were marked on both corners of the cloth with an oil marking pen.

In the manner described as above, 8 sets each consisting of 15 test cloth pieces were prepared.

b) Preparation of Detergency Power Determining Test Solution

1. Reference Detergent for Determining Detergency Power

Sodium linear dodecylbenzenesulfonate, sodium tripolyphosphate, sodium silicate, sodium carbonate, sodium carboxymethylcellulose and sodium sulfate, each of which were prescribed, were mixed at a weight ratio of 15:17:10:3:1:58, and dried at about 105° C., then made into powder. 1.33 g of the powder, in terms of the amount of anhydride, was weighed out and dissolved into 1000 ml of the prescribed use water (obtained by dissolving 133 mg of potassium chloride dihydrate to water to make a total amount of 1000 ml).

There were prepared four of such a reference detergent solution.

2. Each of the liquid detergents A to D of EXAMPLES 1 to 4 was dissolved into 1000 ml of the prescribed use water at 1 g/L.

c) Operation (1) Into 1 L of each of the reference detergent solutions for determining the detergency power and the aqueous detergent solutions of EXAMPLES 1 to 4 (at 30° C.), one set of dirty collar cloth (15 pieces) prepared as test cloth was put. Meanwhile, one set of dirty collar cloth (15 pieces) which make pairs with the above, was put into 1 L of each of the reference detergent solutions. The dirty collar cloth was washed in each detergent solution for 10 minutes using a detergency power testing machine of the prescribed mixing mode (rotation number 120±5 rotations per minute).

(2) After finishing the washing, each sample cloth was squeezed softly and put into 1 L of the prescribed use water of 30° C., so as to be rinsed for 30 minutes, using the mixing type detergency power testing machine noted above. This operation was repeated two times.

(3) After finishing the rinsing, each test cloth was air-dried, and a test cloth cleaned with a reference detergent solution and a corresponding test cloth cleaned with a detergent solution of a respective one of EXAMPLES 1 to 4, were stitched together into a pair, followed by ironing. In this manner, test samples of 15×4 were prepared in total.

d) Evaluation 15 pairs of test sample cloth pieces were placed in the order of marked symbols, and the degree of removing of the dirt on a sample cloth cleaned with the detergent solution of the present invention, as compared to the test cloth of each pair, which was cleaned with the reference detergent solution, was evaluated by three panelists on the basis of the following standard while they compared the test cloth pieces on the left and right sides, of each pair with each other.

−2: clearly inferior

−1: somewhat inferior

0: not substantially different

+1: somewhat superior

+2: clearly superior

The results were indicated in TABLES 2 to 5.

TABLE 2

(Example 1: Detergent A)

| Sample cloth used for judgement No. | Panelist 1 | Panelist 2 | Panelist 3 |
|---|---|---|---|
| 1 | +2 | +2 | +2 |
| 2 | +2 | +2 | +2 |
| 3 | +2 | +2 | +2 |
| 4 | +1 | +2 | +2 |
| 5 | +2 | +2 | +2 |
| 6 | +2 | +2 | +2 |
| 7 | +2 | +2 | +2 |
| 8 | +2 | +2 | +2 |
| 9 | +2 | +2 | +2 |
| 10 | +1 | +1 | +1 |
| 11 | +2 | +2 | +2 |
| 12 | +2 | +2 | +2 |
| 13 | +2 | +2 | +2 |
| 14 | +2 | +2 | +2 |
| 15 | +2 | +2 | +2 |
| Evaluation point | 28 | 29 | 28 |

TABLE 3

(Example 2: Detergent B)

| Sample cloth used for judgement No. | Panelist 1 | Panelist 2 | Panelist 3 |
|---|---|---|---|
| 1 | +2 | +2 | +2 |
| 2 | +1 | +2 | +2 |
| 3 | +2 | +2 | +2 |
| 4 | +2 | +2 | +2 |
| 5 | +2 | +2 | +2 |
| 6 | +2 | +2 | +2 |
| 7 | +2 | +2 | +1 |
| 8 | +2 | +2 | +2 |
| 9 | +2 | +2 | +2 |
| 10 | +2 | +2 | +2 |
| 11 | +1 | +1 | +2 |
| 12 | +2 | +2 | +2 |
| 13 | +2 | +2 | +2 |
| 14 | +2 | +2 | +2 |
| 15 | +1 | +2 | +2 |
| Evaluation point | 27 | 29 | 29 |

TABLE 4

(Example 3: Detergent C)

| Sample cloth used for judgement No. | Panelist 1 | Panelist 2 | Panelist 3 |
|---|---|---|---|
| 1 | +2 | +2 | +2 |
| 2 | +2 | +2 | +2 |
| 3 | +2 | +2 | +2 |
| 4 | +2 | +2 | +2 |
| 5 | +2 | +2 | +2 |
| 6 | +2 | +1 | +2 |
| 7 | +2 | +2 | +2 |
| 8 | +2 | +2 | +2 |
| 9 | +2 | +1 | +1 |
| 10 | +1 | +2 | +2 |
| 11 | +2 | +2 | +2 |
| 12 | +2 | +2 | +2 |
| 13 | +2 | +2 | +2 |
| 14 | +2 | +2 | +2 |
| 15 | +2 | +2 | +2 |
| Evaluation point | 29 | 28 | 29 |

TABLE 5

(Example 4: Detergent D)

| Sample cloth used for judgement No. | Panelist 1 | Panelist 2 | Panelist 3 |
|---|---|---|---|
| 1 | +2 | +2 | +2 |
| 2 | +2 | +2 | +2 |
| 3 | +2 | +2 | +2 |
| 4 | +2 | +2 | +2 |
| 5 | +2 | +2 | +2 |
| 6 | +2 | +2 | +2 |
| 7 | +2 | +2 | +2 |
| 8 | +2 | +2 | +2 |
| 9 | +2 | +2 | +2 |
| 10 | +2 | +2 | +2 |
| 11 | +2 | +2 | +2 |
| 12 | +1 | +2 | +2 |
| 13 | +2 | +2 | +2 |
| 14 | +2 | +2 | +2 |
| 15 | +2 | +2 | +2 |
| Evaluation point | 29 | 30 | 30 |

<Stability>

The four 400 mL-glass containers were filled with the detergents of EXAMPLES 1 to 4, and they were air-tightly stopped. After preserved for one month at 35° C., the stability was evaluated on the basis of the following standards.

○=Separation between alkylbenzenesulfonate and sodium silicate was not observed

Δ=Partial separation between alkylbenzenesulfonate and sodium silicate was observed ×=Separation between alkylbenzenesulfonate and sodium silicate was observed <Cloudiness>

200 ml of each of the detergents of EXAMPLES 1 to 4 was placed in a respective glass container with a stopper, having a diameter of 60 mm, and the cloudiness created by silica in sodium silicate and alkylbenzenesulfonate was evaluated by eye on the basis of the following standards.

○=No cloudiness at all

Δ=A little cloudy

×=Cloudy

<Viscosity>

The detergents A to D obtained in EXAMPLES 1 to 4 were measured in terms of viscosity (cP) using a C-type viscosity meter of TOKYO KEIKI (Co., Ltd.) at 20° C.

The results for the transparency, detergency power evaluation, stability, cloudiness and viscosity are indicated in TABLE 6 below.

TABLE 6

(Evaluation Results)

| Evaluation items | Detergent A | B | C | D |
|---|---|---|---|---|
| Transparency | ○ | ○ | ○ | ○ |
| Cleaning Power | Excellent | Excellent | Excellent | Excellent |
| Stability | ○ | ○ | ○ | ○ |
| Cloudiness | ○ | ○ | ○ | ○ |
| Viscosity (cP) | 184.0 | 184.0 | 170.0 | 200.0 |

EXAMPLES 5 TO 8

Clear liquid detergents E to H having compositions specified in TABLE 7 were prepared in similar manner to those of EXAMPLES 1 to 4 except that the amount of components blended was varied in preparation of the solution (a) and solution (b). In these examples, the aqueous solutions (a) of the alkylbenzenesulfonate salt surfactants did not create the separation of layer at all, and therefore it was not necessary to carry out stirring. Thus, it was made possible to facilitate the continuous production of the clear liquid detergent.

The clear liquid detergents E to H were evaluated in terms of the transparency, detergency power evaluation, stability, cloudiness and viscosity, and substantially the same results as those of the detergents A to D of EXAMPLES 1 to 4 were obtained, which were indicated in TABLE 8 below.

TABLE 7

(Compositions of Detergents E to H)

| Component | | Amount blended (% by weight) Example 5 (Detergent E) | Example 6 (Detergent F) | Example 7 (Detergent G) | Example 8 (Detergent H) |
|---|---|---|---|---|---|
| Alkylbenzenesulfonate aqueous solution | Dodecylbenzene sulfonic aicd | 6.25 | 6.25 | 6.25 | 7.53 |
| | Sodium hydroxide | 1.71875 | 1.71875 | 1.71875 | 2.07 |
| | Water | 42.03125 | 42.03125 | 34.53125 | 30.4 |
| | Sub-total | 50.0 | 50.0 | 42.5 | 40.0 |
| Sodium silicate aqueous solution | Sodium silicate | 4.29 | 4.29 | 5.0 | 5.0 |
| | Ctric acid | | 0.0871 | | |
| | Malic acid | 0.0871 | | 0.0871 | 0.1049 |
| | Tetrasodium ethylenediamine tetraaccetate salt | 0.871 | 0.871 | 0.871 | 1.05 |
| | Water | 7.7519 | 7.7519 | 9.0419 | 7.9451 |
| | Sub-total | 13.0 | 13.0 | 15.0 | 14.1 |
| Mixed surfactant aqueous | Polyoxyethylene alkylether | 5.92 | 2.96 | 6.8 | 7.2 |
| | Alkylether sulfate | 1.036 | 5.18 | 11.9 | 12.4 |
| | Fatty acid alkanol-amide | 0.87 | 0.74 | 0.74 | 0.74 |
| | Water | 19.85 | 28.12 | 23.06 | 25.56 |
| | Sub-total | 37.0 | 37.0 | 42.5 | 45.9 |
| Total | | 100 | 100 | 100 | 100 |
| pH value | | 13.34 | 13.28 | 13.37 | 13.38 |
| 1000-fold diluted pH value | | 7.89 | 7.64 | 7.74 | 7.70 |

TABLE 8

(Evaluation Results)

| Evaluation items | Detergent A | B | C | D |
|---|---|---|---|---|
| Transparency | ○ | ○ | ○ | ○ |
| Cleaning Power | Excellent | Excellent | Excellent | Excellent |
| Stability | ○ | ○ | ○ | ○ |
| Cloudiness | ○ | ○ | ○ | ○ |
| Viscosity (cP) | 180.0 | 180.0 | 220.0 | 220.0 |

As is clear from the results of the above-described EXAMPLES, the clear liquid detergent of the present invention has an excellent transparency, and is stable, does not become cloudy, and exhibits an excellent detergency power.

As described above, according to the present invention, there is provided a clear liquid detergent containing an alkylbenzenesulfonate anionic salt surfactant and sodium silicate, which has an excellent transparency and extremely high detergency power, maintains its transparency for a long period of time, and does not create the separation phenomenon due to the difference in specific gravity, cloudiness, gelation or the like. There has been no such a clear liquid detergent conventionally, but it is provided for the first time by the present invention. Further, with the clear liquid detergent of the present invention, since it contains sodium silicate, the amount of the synthetic surfactant used can be reduced significantly, and therefore it is environmentally preferable detergent.

What is claimed is:

1. A clear liquid detergent consisting of:

an alkylbenzenesulfonate salt anionic surfactant, liquid sodium silicate, a polyoxyethylene alkyl or aryl ether nonionic surfactant, an alkylethersulfate salt anionic surfactant, a metal-chelating agent, a pH adjusting agent, a freezing/clouding inhibitor, water, and an optional component selected from a fluorosurfactant and a viscosity adjusting agent.

2. The clear liquid detergent according to claim 1, which does not contain said optional component.

3. The clear liquid detergent according to claim 1, which contains said fluorosurfactant.

4. The clear liquid detergent according to claim 1, which contains said alkylbenzenesulfonate salt anionic surfactant in an amount of 5 to 15.5% by weight, and said sodium silicate in an amount of 1 to 7.5% by weight.

5. The clear liquid detergent according to claim 4, which contains said polyoxyethylene alkyl or aryl ether nonionic surfactant in an amount of 1 to 10% by weight, said alkylethersulfate salt anionic surfactant in an amount of 1 to 15% by weight, said metal-chelating agent in an amount of 0.5 to 3% by weight, said pH adjusting agent in an amount of 0.05 to 5% by weight, and said freezing/clouding inhibitor in an amount of 0.1 to 3% by weight.

6. The clear liquid detergent according to claim 1, wherein said alkylbenzenesulfonate salt is represented by the formula:

$$RC_6H_4SO_3M$$

where R represents a linear alkyl group having 11 to 14 carbon atoms, and M represents an alkali metal.

7. The clear liquid detergent according to claim 1, wherein said alkylbenzenesulfonate salt anionic surfactant comprises sodium salt of linear dodecylbenzenesulfonate.

8. The clear liquid detergent according to claim 1, wherein said alkylbenzenesulfonate salt is an in-situ reaction product of an alkylbenzenesulfonic acid with an alkali metal.

9. The clear liquid detergent according to claim 8, wherein said alkylbenzenesulfonic acid has 11 to 14 carbon atoms in its alkyl moiety.

10. The clear liquid detergent according to claim 9, wherein said alkylbenzenesulfonic acid is linear dodecylbenzenesulfonic acid.

11. The clear liquid detergent according to claim 1, wherein said nonionic surfactant comprises a polyoxyethylene alkyl ether represented by the formula:

$$RO(CH_2CH_2O)_nH$$

where R represents an alkyl group, and n represents 7 to 10.

12. The clear liquid detergent according to claim 11, wherein said R represents an alkyl group having from 8 to 18 carbon atoms.

13. The clear liquid detergent according to claim 1, wherein said nonionic surfactant comprises a polyoxyethylene alkylphenyl ether represented by the formula:

$$R—C_6H_4—O(CH_2CH_2O)_nH$$

where R represents an alkyl group, and n represents 9 to 12.

14. The clear liquid detergent according to claim 13, wherein said R represents an alkyl group having 8 or 9 carbon atoms.

15. The clear liquid detergent according to claim 1, wherein said alkylethersulfate salt anionic surfactant comprises an alcholethoxysulfate represented by the formula:

$$R—(OCH_2CH_2)_nOSO_3M$$

where R represents a primary alkyl group, M represents a cation, and n represents 1 to 10.

16. The clear liquid detergent according to claim 15, wherein said R represents a primary alkyl group having 12 carbon atoms.

17. The clear liquid detergent according to claim 15, wherein said M represents an alkali metal cation.

18. The clear liquid detergent according to claim 1, wherein said alkylethersulfate salt anionic surfactant comprises an alcholethoxysulfate represented by the formula:

$$R(R')—CH—(OCH_2CH_2)_nOSO_3M$$

where R represents an alkyl group, R' represents an alkyl group, M represents a cation, and n represents 1 to 10.

19. The clear liquid detergent according to claim 18, wherein said R represents an alkyl group having from 6 to 10 carbon atoms, said R' represents an alkyl group having from 2 to 4 carbon atoms, and said M represents an alkali metal cation.

20. The clear liquid detergent according to claim 1, wherein said metal-chelating agent comprises a substance selected from the group consisting of ethylenediaminetetraacetic acid, tetrasodium ethylenediaminetetraacetate and disodium ethylenediaminetetraacetate.

21. The clear liquid detergent according to claim 1, wherein said pH adjusting agent comprises a substance selected from the group consisting of malic acid and citric acid.

22. The clear liquid detergent according to claim 1, wherein said freezing/clouding inhibitor comprises a fatty acid alkanolamide.

23. The clear liquid detergent according to claim 22, wherein said fatty acid alkanolamide is a condensation product of a fatty acid having from 8 to 18 carbon atoms with an alkanolamine having from 8 to 18 carbon atoms.

24. The clear liquid detergent according to claim 3, which contains said fluorosurfactant in an amount of 0.01 to 0.1% by weight.

25. The clear liquid detergent according to claim 3, wherein said fluorosurfactant comprises a perfluoroalkylcarboxylic acid.

26. A clear liquid detergent consisting of:

an alkylbenzenesulfonate salt anionic surfactant, liquid sodium silicate, a polyoxyethylene alkyl or aryl ether nonionic surfactant, an alkylethersulfate salt anionic surfactant, a metal-chelating agent, a pH adjusting agent, a freezing/clouding inhibitor, water, and optionally a fluorosurfactant;

wherein said detergent being prepared by blending liquid sodium silicate in an amount of 1 to 7.5% by weight, a metal-chelating agent in an amount of 0.5 to 3% by weight, a pH adjusting agent in an amount of 0.05 to 5% by weight, an alkylbenzenesulfonic acid in an amount of 5 to 15% by weight, an alkali metal hydroxide in an amount of 1 to 4.5% by weight as a neutralizing agent for said alkylbenzenesulfonic acid to provide said alkylbenzenesulfonate salt anionic surfactant, a fluorosurfactant in an amount of 0 to 0.1% by weight, polyoxyethylene alkyl or aryl ether nonionic surfactant in an amount of 1 to 10% by weight, an alkylethersulfate salt anionic surfactant in an amount of 1 to 15% by weight, a freezing/clouding inhibitor in an amount of 0.1 to 3% by weight, and the balance of water.

27. The clear liquid detergent according to claim 26, which contains no fluorosurfactant.

28. The clear liquid detergent according to claim 26, which contains said fluorosurfactant.

29. The clear liquid detergent according to claim 26, wherein said alkylbenzenesulfonic acid has 11 to 14 carbon atoms in its alkyl moiety.

30. The clear liquid detergent according to claim 26, wherein said alkylbenzenesulfonic acid is linear dodecylbenzenesulfonic acid.

31. The clear liquid detergent according to claim 26, wherein said nonionic surfactant comprises a polyoxyethylene alkyl ether represented by the formula:

$$RO(CH_2CH_2O)_nH$$

where R represents an alkyl group, and n represents 7 to 10.

32. The clear liquid detergent according to claim 31, wherein said R represents an alkyl group having from 8 to 18 carbon atoms.

33. The clear liquid detergent according to claim 26, wherein said nonionic surfactant comprises a polyoxyethylene alkylphenyl ether represented by the formula:

$$R—C_6H_4—O(CH_2CH_2O)_nH$$

where R represents an alkyl group, and n represents 9 to 12.

34. The clear liquid detergent according to claim 33, wherein said R represents an alkyl group having 8 or 9 carbon atoms.

35. The clear liquid detergent according to claim 26, wherein said alkylethersulfate salt anionic surfactant comprises an alcholethoxysulfate represented by the formula:

$$R—(OCH_2CH_2)_nOSO_3M$$

where R represents a primary alkyl group, M represents a cation, and n represents 1 to 10.

36. The clear liquid detergent according to claim 35, wherein said R represents a primary alkyl group having 12 carbon atoms.

37. The clear liquid detergent according to claim 35, wherein said M represents an alkali metal cation.

38. The clear liquid detergent according to claim 26, wherein said alkylethersulfate salt anionic surfactant comprises an alcholethoxysulfate represented by the formula:

$$R(R')—CH—(OCH_2CH_2)_nOSO_3M$$

where R represents an alkyl group, R' represents an alkyl group, M represents a cation, and n represents 1 to 10.

39. The clear liquid detergent according to claim 38, wherein said R represents an alkyl group having from 6 to 10 carbon atoms, said R' represents an alkyl group having from 2 to 4 carbon atoms, said M represents an alkali metal cation.

40. The clear liquid detergent according to claim 26, wherein said metal-chelating agent comprises a substance selected from the group consisting of ethylenediaminetetraacetic acid, tetrasodium ethylenediaminetetraacetate and disodium ethylenediaminetetraacetate.

41. The clear liquid detergent according to claim 26, wherein said pH adjusting agent comprises a substance selected from the group consisting of malic acid and citric acid.

42. The clear liquid detergent according to claim 26, wherein said freezing/clouding inhibitor comprises a fatty acid alkanolamide.

43. The clear liquid detergent according to claim 42, wherein said fatty acid alkanolamide is a condensation product of a fatty acid having from 8 to 18 carbon atoms with an alkanolamine having from 8 to 18 carbon atoms.

44. The clear liquid detergent according to claim 28, which contains said fluorosurfactant in an amount of 0.01 to 0.1% by weight.

45. The clear liquid detergent according to claim 28, wherein said fluorosurfactant comprises a perfluoroalkylcarboxylic acid.

46. The clear liquid detergent according to claim 26, wherein said liquid sodium silicate is present in an amount of 1 to 6% by weight, said metal-chelating agent is present in an amount of 0.5 to 2.5% by weight, said pH adjusting agent is present in an amount of 0.05 to 4% by weight, said alkylbenzenesulfonic acid is present in an amount of 5 to 12.5% by weight, said alkali metal hydroxide is present in an amount of 1 to 4% by weight, said fluorosurfactant is present in an amount of 0 to 0.09% by weight, said polyoxyethylene alkyl or aryl ether nonionic surfactant is present in an amount of 1 to 8.5% by weight, said alkylethersulfate salt anionic surfactant is present in an amount of 1 to 14% by weight, and said freezing/clouding inhibitor is present in an amount of 0.1 to 2.5% by weight.

47. A clear liquid detergent consisting of:

an alkylbenzenesulfonate salt anionic surfactant, liquid sodium silicate, a polyoxyethylene alkyl or aryl ether nonionic surfactant, an alkylethersulfate salt anionic surfactant, a metal-chelating agent, a pH adjusting agent, a freezing/clouding inhibitor, water, and optionally a fluorosurfactant; wherein said detergent being prepared by adding, to (1) an aqueous solution of a mixed surfactant containing polyoxyethylene alkyl or aryl ether nonionic surfactant, a freezing/clouding inhibitor, alkylethersulfate salt anionic surfactant, water, and optionally a fluorosurfactant, (2) a sodium silicate aqueous solution containing liquid sodium silicate, a metal-chelating agent, a pH adjusting agent and water, and adding, to the resultant mixture, (3) an aqueous solution of alkylbenzenesulfonate salt anionic surfactant prepared by adding, to alkylbenzenesulfonic acid, water and an alkali metal hydroxide used as a neutralizing agent for said alkylbenzenesulfonic acid to provide said alkylbenzenesulfonate salt anionic surfactant.

48. The clear liquid detergent according to claim 47, which contains said alkylbenzenesulfonate salt anionic surfactant in an amount of 5 to 15.5% by weight, said sodium silicate in an amount of 1 to 7.5% by weight, said fluorosurfactant in an amount of 0 to 0.1% by weight, said polyoxyethylene alkyl or aryl ether nonionic surfactant in an amount of 1 to 10% by weight, said alkylethersulfate salt anionic surfactant in an amount of 1 to 15% by weight, said metal-chelating agent in an amount of 0.5 to 3% by weight, said pH adjusting agent in an amount of 0.05 to 5% by weight, said freezing/clouding inhibitor in an amount of 0.1 to 3% by weight and the balance of water.

49. The clear liquid detergent according to claim 48, wherein said alkylbenzenesulfonic acid comprises linear dodecylbenzenesulfonic acid.

50. The clear liquid detergent according to claim 49, wherein said metal-chelating agent comprises tetrasodium ethylenediaminetetraacetate.

51. The clear liquid detergent according to claim 50, wherein said pH adjusting agent comprises a substance selected from the group consisting of malic acid and citric acid.

52. The clear liquid detergent according to claim 51, wherein said freezing/clouding inhibitor comprises a fatty acid alkanolamide.

53. A clear liquid detergent consisting of:

5 to 15.5% by weight of an alkylbenzenesulfonate salt anionic surfactant comprising sodium salt of linear dodecylbenzenesulfonate, 1 to 7% by weight of liquid sodium silicate, 1 to 10% by weight of a polyoxyethylene alkyl or aryl ether nonionic surfactant comprising at least one member selected from the group consisting of a polyoxyethylene alkyl ether represented by the formula:

$$RO(CH_2CH_2O)_nH$$

where R represents an alkyl group having 8 to 18 carbon atoms, and n represents 7 to 10; and a polyoxyethylene alkylphenyl ether is represented by the formula:

$$R—C_6H_4—O(CH_2CH_2O)_nH$$

where R represents an alkyl group having 8 or 9 carbon atoms, and n represents 9 to 12, 1 to 15% by weight of alkylethersulfate salt anionic surfactant comprising at least one member selected from the group consisting of an alcholethoxysulfate represented by the formula:

$$R—(OCH_2CH_2)_nOSO_3M$$

where R represents a primary alkyl group having 12 carbon atoms, M represents an alkali metal cation, and n represents 1 to 10; and an alcholethoxysulfate represented by the formula:

$$R(R')—CH—(OCH_2CH_2)_nOSO_3M$$

where R represents an alkyl group having 6 to 10 carbon atoms, R' represents an alkyl group having 2 to 4 carbon atoms, M represents an alkali metal cation, and n represents 1 to 10, 0.5 to 3% by weight of tetrasodium ethylenediaminetetraacetate, 0.05 to 5% by weight of malic acid and/or citric acid, 0.1 to 3% by weight of a fatty acid alkanolamide which is a condensation product of a fatty acid having from 8 to 18 carbon atoms with an alkanolamine having from 8 to 18 carbon atoms, and the balance of water.

54. The clear liquid detergent according to claim 53, which contains sail alkylbenzenesulfonate salt anionic surfactant in an amount of 5 to 8.5% by weight; said liquid sodium silicate in an amount of 4 to 5.5% by weight; said polyoxyethylene alkyl or aryl ether nonionic surfactant in an amount of 1 to 8.5% by weight; said alkylethersulfate salt anionic surfactant in an amount of 1 to 14% by weight; said tetrasodium ethylenediaminetetraacetate in an amount of 0.5 to 2.5% by weight; said malic acid and/or citric acid in an amount of 0.05 to 4% by weight; and said fatty acid alkanolamide in an amount of 0.1 to 2.5% by weight.

55. A clear liquid detergent consisting of:

5 to 15.5% by weight of an alkylbenzenesulfonate salt anionic surfactant comprising sodium salt of linear dodecylbenzenesulfonate, 1 to 7% by weight of liquid sodium silicate, 1 to 10% by weight of a polyoxyethylene alkyl or aryl ether nonionic surfactant comprising at least one member selected from the group consisting of a polyoxyethylene alkyl ether represented by the formula:

$$RO(CH_2CH_2O)_nH$$

where R represents an alkyl group having 8 to 18 carbon atoms, and n represents 7 to 10; and a polyoxyethylene alkylphenyl ether is represented by the formula:

$$R—C_6H_4—O(CH_2CH_2O)_nH$$

where R represents an alkyl group having 8 or 9 carbon atoms, and n represents 9 to 12, 1 to 15% by weight of an alkylethersulfate salt anionic surfactant comprising at least one member selected from the group consisting of an alcholethoxysulfate represented by the formula:

$$R—(OCH_2CH_2)_nOSO_3M$$

where R represents a primary alkyl group having 12 carbon atoms, M represents an alkali metal cation, and n represents 1 to 10; and an alcholethoxysulfate represented by the formula:

$$R(R')—CH—(OCH_2CH_2)_nOSO_3M$$

where R represents an alkyl group having 6 to 10 carbon atoms, R' represents an alkyl group having 2 to 4 carbon atoms, M represents an alkali metal cation, and n represents 1 to 10, 0.01 to 0.1% by weight of a fluorosurfactant comprising a perfluoroalkylcarboxylic acid, 0.5 to 3% by weight of tetrasodium ethylenediaminetetraacetate, 0.05 to 5% by weight of malic acid and/or citric acid, 0.1 to 3% by weight of a fatty acid alkanolamide which is a condensation product of a fatty acid having from 8 to 18 carbon atoms with an alkanolamine having from 8 to 18 carbon atoms, and the balance of water.

56. The clear liquid detergent according to claim 1, which exhibits a pH value of greater than 7 but lower than 8 when diluted 1000-fold with water.

57. The clear liquid detergent according to claim 26, which exhibits a pH value of greater than 7 but lower than 8 when diluted 1000-fold with water.

58. The clear liquid detergent according to claim 47, which exhibits a pH value of greater than 7 but lower than 8 when diluted 1000-fold with water.

59. The clear liquid detergent according to claim 53, which exhibits a pH value of greater than 7 but lower than 8 when diluted 1000-fold with water.

60. The clear liquid detergent according to claim 55, which exhibits a pH value of greater than 7 but lower than 8 when diluted 1000-fold with water.

61. The clear liquid detergent according to claim 5, which is diluted with water at a ratio of 0.8 to 1.0 g of the detergent per liter of water.

62. The clear liquid detergent according to claim 26, which is diluted with water at a ratio of 0.8 to 1.0 g of the detergent per liter of water.

63. The clear liquid detergent according to claim 48, which is diluted with water at a ratio of 0.8 to 1.0 g of the detergent per liter of water.

64. The clear liquid detergent according to claim 53, which is diluted with water at a ratio of 0.8 to 1.0 g of the detergent per liter of water.

65. The clear liquid detergent according to claim 55, which is diluted with water at a ratio of 0.8 to 1.0 g of the detergent per liter of water.

* * * * *